US007339778B1

(12) United States Patent
Gefter et al.

(10) Patent No.: US 7,339,778 B1
(45) Date of Patent: Mar. 4, 2008

(54) CORONA DISCHARGE STATIC NEUTRALIZING APPARATUS

(75) Inventors: Peter Gefter, South San Francisco, CA (US); Scott Gehlke, Berkeley, CA (US); Lawrence B. Levit, Alamo, CA (US); Dennis A. Leri, Pleasant Hill, CA (US)

(73) Assignee: Ion Systems, Alameda, CA (US)

( * ) Notice: Subject to any disclaimer, the term of this patent is extended or adjusted under 35 U.S.C. 154(b) by 356 days.

(21) Appl. No.: 10/459,865

(22) Filed: Jun. 11, 2003

(51) Int. Cl.
*H01H 47/00* (2006.01)

(52) U.S. Cl. ..... 361/213; 316/220

(58) Field of Classification Search ..... 361/212–220
See application file for complete search history.

(56) References Cited

U.S. PATENT DOCUMENTS

| | | | | | |
|---|---|---|---|---|---|
| 2,965,481 | A | * | 12/1960 | Gundlach | 430/31 |
| 3,075,078 | A | * | 1/1963 | Olden | 250/326 |
| 3,706,938 | A | * | 12/1972 | Petriw | 324/459 |
| 3,770,972 | A | * | 11/1973 | Hastwell | 250/324 |
| 3,777,158 | A | * | 12/1973 | Kamogawa et al. | 250/324 |
| 3,996,795 | A | * | 12/1976 | Servassier | 73/861.09 |
| 4,027,201 | A | | 5/1977 | Bacon et al. | |
| 4,130,852 | A | | 12/1978 | Peffer et al. | |
| 4,227,234 | A | * | 10/1980 | Seanor et al. | 361/229 |
| 4,740,862 | A | * | 4/1988 | Halleck | 361/231 |
| 5,153,811 | A | * | 10/1992 | Rodrigo et al. | 361/231 |
| 5,424,103 | A | * | 6/1995 | Ahn | 427/569 |
| 5,469,242 | A | * | 11/1995 | Yu et al. | 399/172 |
| 5,627,376 | A | * | 5/1997 | Jaisinghani et al. | 250/325 |
| 5,672,871 | A | * | 9/1997 | Jacobs et al. | 250/324 |
| 5,891,409 | A | * | 4/1999 | Hsiao et al. | 423/239.1 |
| 6,038,120 | A | * | 3/2000 | May et al. | 361/227 |
| 6,086,675 | A | * | 7/2000 | Hamamoto et al. | 118/620 |
| 2003/0039485 | A1 | * | 2/2003 | Yoshiyama | 399/171 |

* cited by examiner

*Primary Examiner*—Michael Sherry
*Assistant Examiner*—Danny Nguyen
(74) *Attorney, Agent, or Firm*—Fenwick & West LLP

(57) ABSTRACT

A corona discharge static neutralizing device includes a wire electrode retained in tension between spaced ends of a resilient support member that is positioned within a flowing air stream. Another electrode aligned with and spaced from the wire electrode promotes a flowing ion stream, when connected to receive an ionizing difference of potential, that flows in skew orientation relative to the flowing air stream. Multiple wire electrodes are supported in tension on a resilient support member along with another electrode disposed on the support member intermediate the wire electrodes and in substantially the same plane therewith.

27 Claims, 5 Drawing Sheets

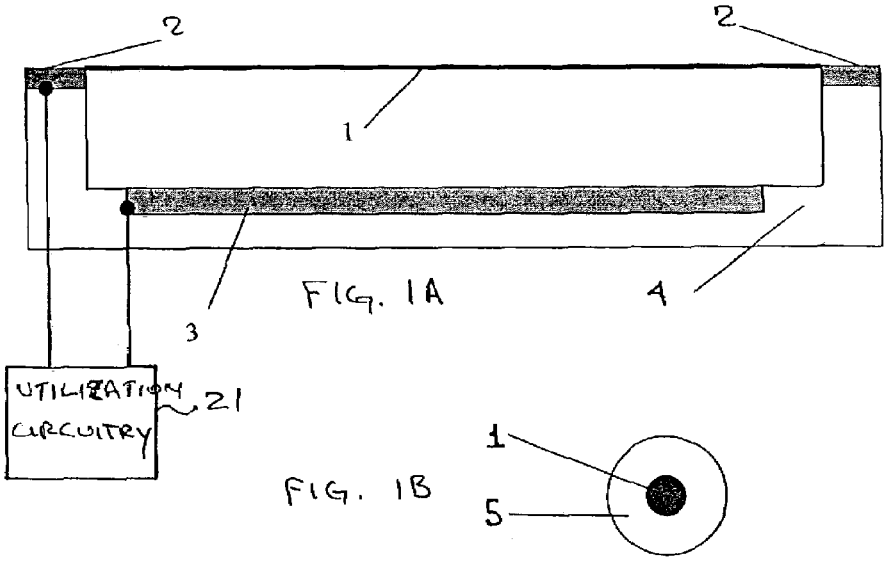
FIG. 1A
FIG. 1B
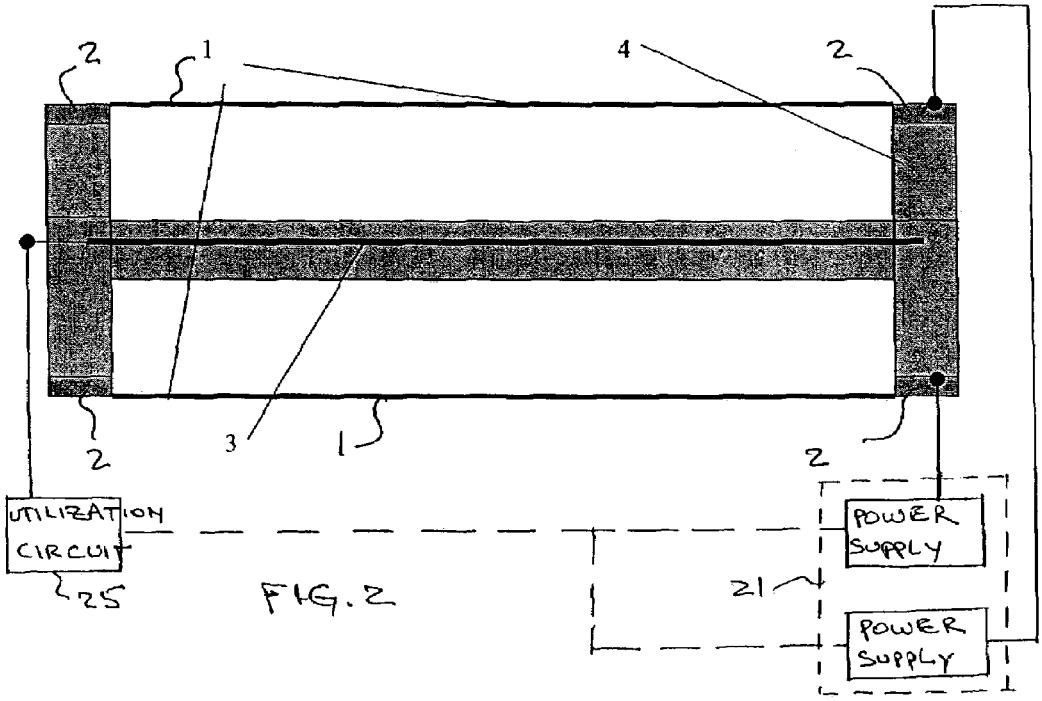
FIG. 2

CORONA DISCHARGE STATIC NEUTRALIZING APPARATUS

FIELD OF THE INVENTION

This invention relates to ion generators and more particularly to static neutralizing apparatus for efficiently delivering ions in a flowing stream of air or other gas.

BACKGROUND OF THE INVENTION

Electrode structure for generating ions of one or other polarity commonly rely upon a point emitter to establish an intense electrical field about the point sufficient to form ions in response to an applied ionizing voltage. However, ions generated in this manner for delivery within a flowing stream of air or other gas are significantly immobilized by the intense electrical field and may be poorly delivered into the flowing stream.

Long, thin wire electrodes are known for generating ionizing electric fields over linear dimensions, for example, for delivering ions of one polarity to a closely-spaced charging object such as an imaging drum of an xerographic printing device. However, an ionizing electrode of this type is usually mounted very close to the charging object and in tension over the span of its length to assure reasonably accurate spacing between the wire electrode and imaging drum.

SUMMARY OF THE INVENTION

In accordance with one embodiment of the present invention, a non-conductive support member retains a thin ion-emitting wire electrode in proximity to a low voltage electrode, all disposed within a flowing air stream. Various configurations of support member are configured to minimize air-flow restrictions in order to improve the efficiency of ion delivery from the ion-emitting wire electrode to the flowing air stream.

BRIEF DESCRIPTION OF THE DRAWINGS

FIG. 1A is a plan view of one embodiment of the apparatus according to the present invention;

FIG. 1B is a sectional view of a coated electrode wire in accordance with the present invention;

FIG. 2 is a multiple-electrode configuration of the apparatus of FIG. 1;

DETAILED DESCRIPTION OF THE INVENTION

Figure 4:
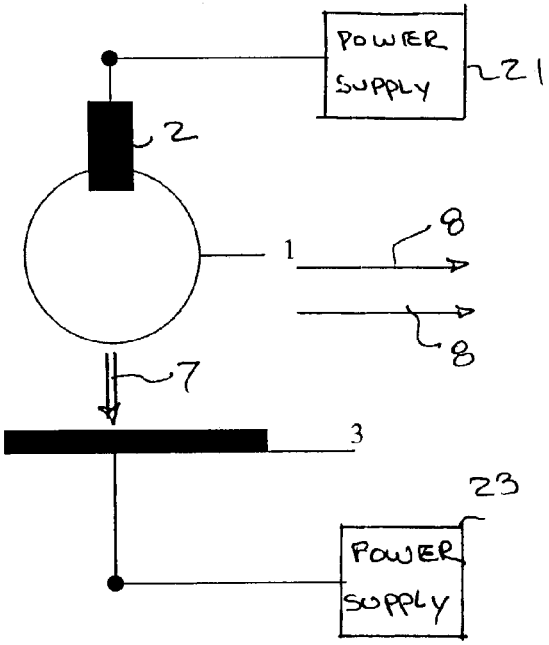
FIG. 4 is a plan view of another embodiment of a thin-wire electrode according to the present invention.

Referring now to FIG. 1A, there is shown a plan view of one embodiment of the present invention in which a generally U-shaped support member 4 is formed of non-conductive electrically-insulating resilient material such as printed-circuit substrate, or polycarbonate, or the like. Conductive pads 2 are disposed at upper ends of the U-shaped support member and a low voltage electrode 3 is also disposed in the root or base of the U-shaped support member 4. A thin wire 1 forms a high-voltage emitter electrode in the span between the upper ends of the support member 4. In this configuration, the wire electrode 1 may be attached as by soldering, welding, crimping, riveting, or the like to the conductive pads 2 while the support member 4 is slightly flexed inwardly to retain the wire electrode 1 in tension upon return of the support member 4 toward its relaxed shape. The low voltage electrode 3 and the high voltage electrode 1 are thus configured to reside in substantially the same plane, for mounting and connections into electrical circuits 21, as later described herein. The distance between the low and high voltage electrodes 1, 3 may be in the range of about 0.4 to about 0.8 inches, and preferably in the range of about 0.5-0.6 inches for operation of the high voltage wire electrode at voltages in the range from about 3KV to about 10KV. The spacing can be optimized for the associated operating conditions of voltage (and frequency of AC ionizing voltage) and air-flow velocity over the structure. In addition, the thickness and elastic properties of the support member 4 should be greater than such properties of the wire electrode 1. Specifically, the thickness of the support member 4 should be about 10-20 times greater, and preferably 10-12 times greater than the diameter of the wire electrode 1 to provide desirable aerodynamic properties to the structure, for reasons as later described herein. In addition, the Young's modulus of elasticity of the support member 4 should be significantly greater than the Young's modulus of elasticity of the wire electrode 1 to assure reliable tensioning of the wire electrode 1 on the support member 4 over time and temperature of operating conditions.

Referring to the sectional view of FIG. 1B, there is shown an insulating coating 5 such as glass or ceramic overlaying the electrode wire 1 for use in ultra-clean environments in which corona discharge and associated electroerosion of particles from the wire electrode 1 is unacceptable. In this configuration, the electrode wire is operable on high ionizing AC applied voltage in the range of about 3KV-10KV (rms) at a frequency of about 50-100,000 Hz.

Referring now to FIG. 2, there is shown a top view of another embodiment of the present invention in which the support member 4 includes a pair of substantially U-shaped supports disposed in back-to-back configuration substantially as an H-shaped support member 4. The extreme ends of the H-shaped uprights each includes a conductive pad 2 that supports and connects to a tensioned, thin electrode wire 1, in the manner as previously described herein. In addition, the root or lateral segment of the H-shaped support member includes a low voltage electrode 3 disposed intermediate the high-voltage emitter electrode wires 1.

Figure 3:
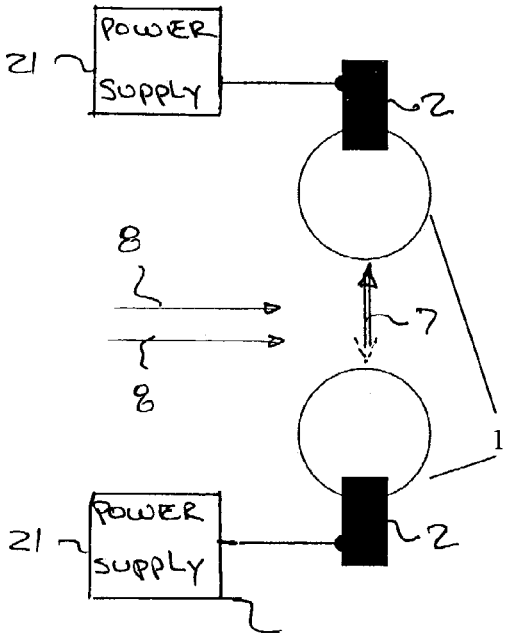
FIG. 3 is a plan view of another embodiment of thin-wire electrodes according to the present invention.

Referring now to FIGS. 3 and 4, there are shown alternative configurations of the wire electrodes 1 according to the present invention in which the electrode 1 is disposed in a loop attached to a conductive pad 2. In the embodiment of FIG. 3, the loops may be closely spaced apart from each other to establish interactive electrical fields therebetween. Similarly, in the embodiment of FIG. 4, a loop electrode 1 is disposed closely adjacent a planar electrode 3 to establish interactive electrical-fields therebetween. Alternatively, each of the individual loops may be associated with a helical winding of a wire electrode having a longitudinal axis disposed substantially normal to the page for delivering ions to a stream 8 of air flowing over the structure. The loop radius may be in the range of about 0.05" to 2", and preferably in the range of about 0.1" to 0.5". The diameter of the wire forming the loop electrode may be in the range from about 2 to 5 mils, and preferably in about 2.4 to 2.5 mils.

Figure 5:
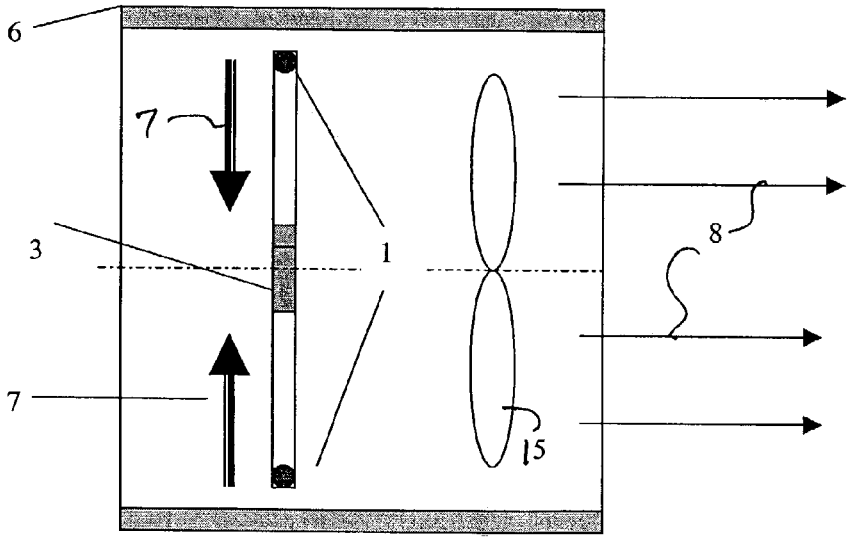
FIG. 5 is a pictorial illustration of one electrode structure within an air-flow delivery system.

Referring now to FIG. 5, there is shown a pictorial sectional view of apparatus for delivering ions in a flowing stream 8 of air in accordance with the present invention. A fan 15 moves a stream 8 of air within a surrounding insulative shroud 6 past an electrode structure, for example, as illustrated and described herein with reference to FIG. 2. The delivery of ions into the flowing air stream 8 is dependent upon the electrode positions relative to the flowing air stream 8. Ideally, the ratio of ion-generating area to area obstructing air flow past the electrodes is greater for wire electrode than for emitter point electrode. Air flow is very efficient at moving ions when they are not tightly bound by the electrical field. The electrostatic field intensity is at a maximum at the surface of the wire electrode 1, where all ions are created. A minimum field intensity occurs on the surface of the low voltage electrode 3. In a strong electrical field, ions are not free to follow the air flow. For that reason, the electrode arrangements according to the present invention are positioned so that the low-voltage electrode 3 is located upstream and the high-voltage wire electrode 1 is located downstream in the air flow, as shown in FIG. 8, to maximize the ion harvest into the air flow 8.

In some applications, the air flow is not uniform. In that case, it is possible to maximize ion harvest by utilizing aerodynamic forces to move the ions most efficiently. In order to accomplish this, the ionizer should have the maximum airflow at the flat low voltage electrode, typically realized near the periphery of an axial fan within a confining shroud 6.

Figure 6:
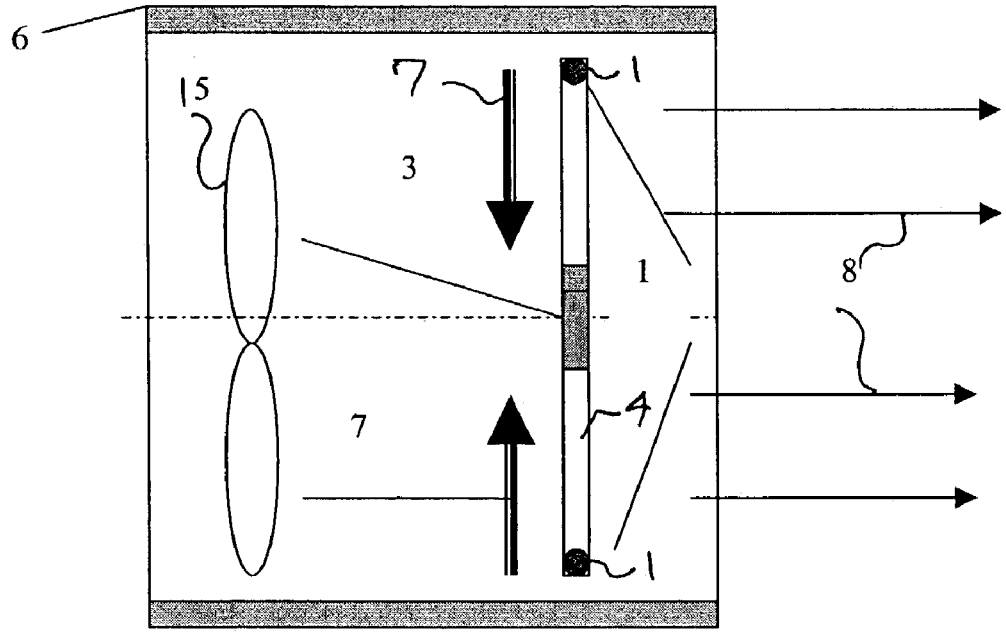
FIG. 6 is a pictorial illustration of another embodiment of an electrode structure within an air-flow delivery system according to the present invention.

It has been determined that optimum delivery of generated ions into air stream 8 from wire electrode 1 occurs where the ion stream flows perpendicular to, or in opposite direction to, air flow. Thus, as illustrated in FIG. 5, an H-shaped structure as shown in FIG. 2 is disposed perpendicular to the air flow 8 and orients the low-voltage electrode 3 and the high-voltage, ion-emitting thin-wire electrodes 1 across the air flow. This establishes ion streams 7 flowing normal to the air flow 8 established by the fan 15 that is positioned downstream of the ion-generating structure. In this configuration, the fan should ideally be formed of non-conductive material, or include non-conductive surface coating on conductive fan components. Alternatively, as illustrated in FIG. 6, the fan 15 may be disposed upstream of the ion-generating structure including an H-shaped support member 4, as illustrated in FIG. 2.

Figure 7:
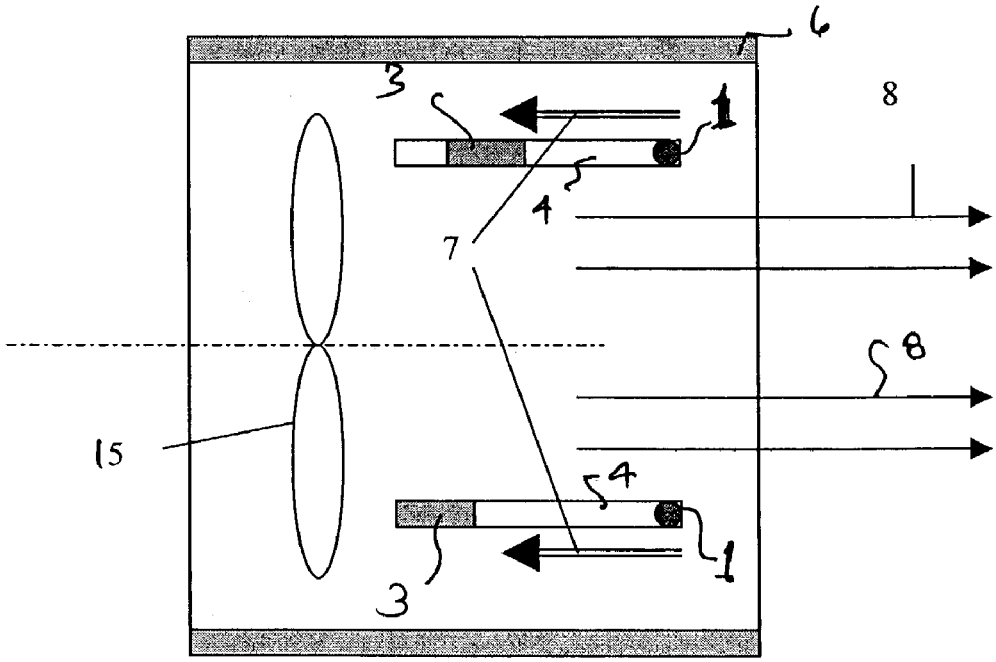
FIG. 7 is a pictorial illustration of another embodiment of an electrode structure within an air-flow delivery system according to the present invention.
Figure 8:
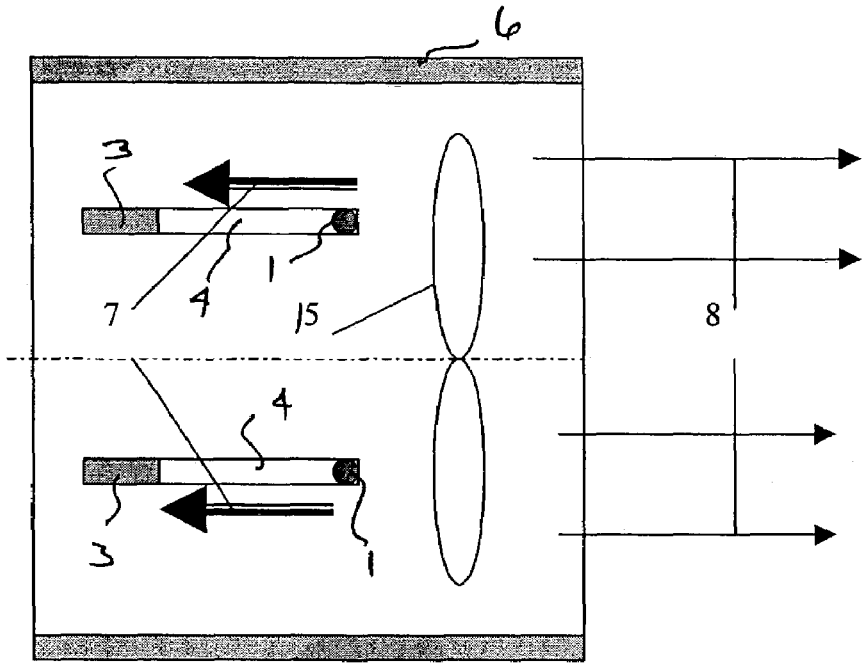
FIG. 8 is a pictorial illustration of another embodiment of an electrode structure within an air-flow delivery system according to the present invention.

Referring now to FIGS. 7 and 8, there are shown other embodiments in which the ion-generating structures including U-shaped support members 4, as illustrated in FIG. 1, are oriented within a flowing air stream 8 to form an ion stream 7 in opposite direction to the air flow stream 8. In these embodiments, the fan 15 may be disposed either upstream of the ion-generating structure, as illustrated in FIG. 7, or downstream of the ion-generating structure, as illustrated in FIG. 8.

Figure 9:
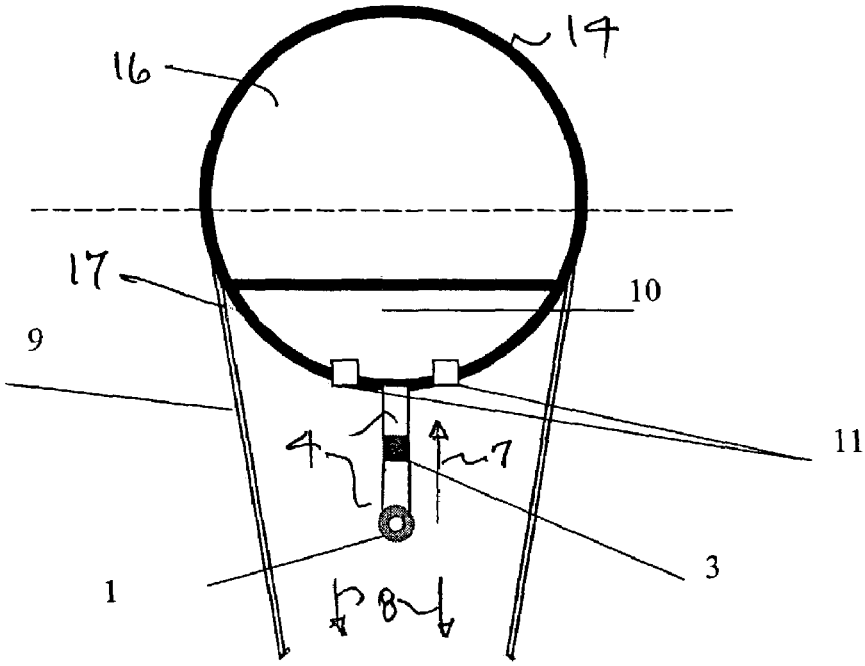
FIG. 9 is a pictorial sectional view of a delivery system for gas under pressure including an electrode structure according to the present invention.

Referring now to the sectional view of an elongated corona-generating structure as illustrated in FIG. 9, there is shown a housing 14 including an upper chamber for containing electrical components, and a lower chamber 10 for containing air (or other gas) under pressure. A lower shroud 17 of electrically non-conductive material forms a shield about the ion-generating structure including low voltage electrode 3 and high voltage wire electrode 3 (shown with a coating 5, as illustrated and described with reference to FIG. 1B) on support member 4 in a configuration as illustrated in FIG. 1A. This ion-generating structure produces an ion stream 7 flowing in a direction opposite to the direction of air (or other gas) flowing 8 under pressure from chamber 10 through aperture 11. These oppositely-directed flows of the ion stream 7 and air stream 8 are found to promote more efficient delivery of the generated ions into the air stream 8 away from the influence of associated electrical fields.

In operation, the wire electrode 1 in each of the illustrated embodiments is connected to receive a high ionizing voltage of either polarity or of alternating polarity from an associated power supply 21. The low-voltage electrode 3 may be connected to a reference potential 23 such as ground, or may be connected as a balance-sensing electrode in a circuit 25 of conventional design for controlling in known manner at least one or other of the polarized voltages to alter the quantities of ions of one or other polarity delivered within the air stream 8. Of course, a wire electrode 1 may be alternately switched between sources of high ionizing voltages of opposite polarities, or may be pulsed intermittently with DC of one polarity, or may be connected (e.g., capacitively) to an AC source of high ionizing voltage or directly connected to a DC source of high ionizing voltage of one polarity.

Figure 10:
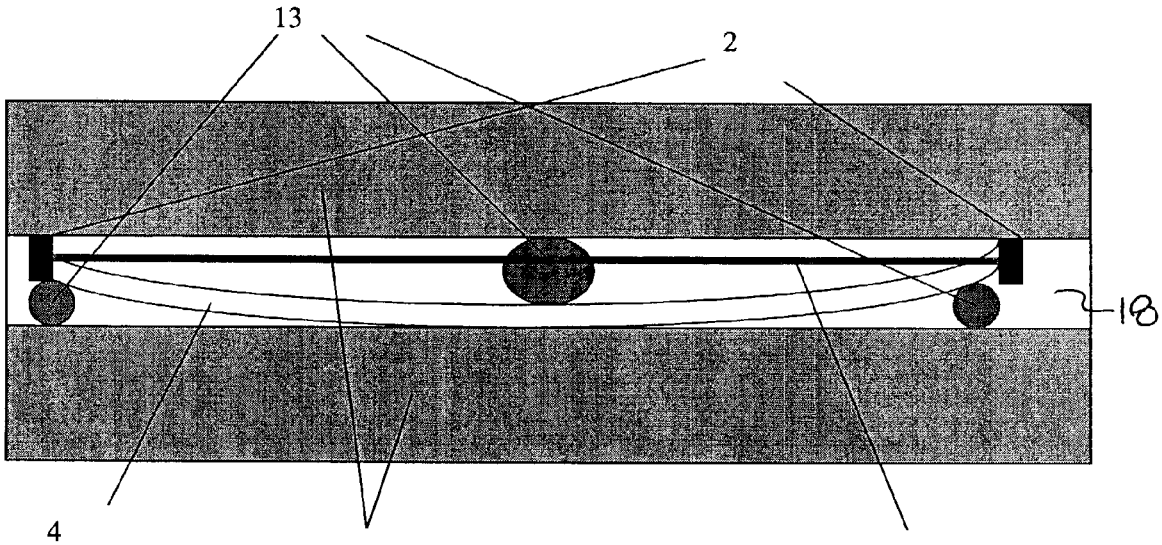
FIG. 10 is a plan view of an electrode structure according to the present invention for fabrication within a confined slot in accordance with the present invention.

Referring now to FIG. 10, there is shown one embodiment of an ion-generating structure according to the present invention for fabrication within a slot or elongated recess 18 within a fixture 12. In this embodiment, a resilient, flexible support member 4 includes conductive end pieces 2 to which the wire electrode 1 is attached while the support member 4 is flexed by spacers 13 positioned between the support member 4 and walls of the groove in fixture 12. After firmly attaching the wire electrode 1 to the end pieces 2, the spacers 13 may be removed. The support member 4 resiliently returns toward its normal shape, thereby tensioning the wire electrode 1 in a composite structure suitable for operation in the manner as illustrated and described herein. Such fabricated structure may be mounted and distributed for operation and replacement in a larger structure as a disposable cartridge. As illustrated and described herein circuitry connected to the non-wire electrode 3 may be either a source of reference potential such as ground, or a source of low voltage, or a circuit 25 for sensing ions in the vicinity of such electrode in order to control one or more sources of high ionizing voltage in known manner to achieve a selected balance or unbalanced condition of ions flowing in an air stream 8.

Therefore, the ion-generating structures in accordance with the present invention establish ion streams that can be oriented in directions normal to, or in opposition to, the directions of flowing streams of air or other gas. This promotes more effective delivery of generated ions within the flowing stream.

What is claimed is:

1. Corona discharge static neutralizing apparatus for disposition within a flowing gas stream directed toward an object for neutralizing the object of electrostatic charges of either polarity, the apparatus comprising:

a substantially flat support member of non-conductive material including conductive regions disposed thereon near a pair of spaced ends oriented in a common plane with the support member;

at least one wire electrode supported in tension between the conductive regions near the pair of spaced ends of the support member;

a reference electrode disposed away from the wire electrode substantially in the common plane therewith; and a structure disposed to form a flowing gas stream about the support member.

2. Corona discharge static neutralizing apparatus according to claim 1 in which the support member is formed in substantially U-shape within the common plane between the spaced ends.

3. Corona discharge static neutralizing apparatus as in claim 1 in which the at least one wire electrode is connected to receive a source of high ionizing voltage.

4. Corona discharge static neutralizing apparatus according to claim 1 in which the spaced ends each include conductive regions; and the at least one wire electrode is connected to the conductive regions.

5. Corona discharge static neutralizing apparatus according to claim 3 in which the source of high ionizing voltage supplies at least one of AC, DC of one polarity, DC of periodic alternating polarity, and pulsed DC of one polarity.

6. Corona discharge static neutralizing apparatus for disposition within a flowing gas stream, the apparatus comprising:

a flat support member of non-conductive material including conductive regions disposed thereon near at least two pairs of spaced ends that are disposed substantially within a common plane;

at least one wire electrode supported in tension between the conductive regions near each of the at least two pairs of the spaced ends of the support member and configured to receive a high ionizing voltage of at least one polarity; and a reference electrode disposed intermediate the wire electrodes substantially in alignment therewith and in the common plane therewith as supported between the at least two pairs of conductive regions, and configured to supply a signal thereon for controlling a high ionizing voltage applied to the wire electrodes.

7. Corona discharge static neutralizing apparatus comprising:

a support member including a pair of wire electrodes supported in tension between respective pairs of spaced ends, and including a reference electrode disposed intermediate the wire electrodes;

a source of high ionizing voltage connected to each of the pair of wire electrodes, and a source of reference voltage connected to the reference electrode to provide an ion stream along a direction between a wire electrode and the reference electrode; and a structure disposed relative to the support member for moving gas in a stream toward an object to be neutralized of static charge along a direction skewed relative to the direction of the ion stream;

the pairs of spaced ends of the support member being mounted with respect to the structure with the direction of spacing between the reference electrode and a said wire electrode skewed relative to the direction of the moving stream of gas.

8. Corona discharge static neutralizing apparatus according to claim 7 in which each of the pair of wire electrodes mounted on the support member is connected to a source of high ionizing voltage of one and opposite polarities.

9. Corona discharge static neutralizing apparatus according to claim 8 in which the plane of the pair of wire electrodes is disposed substantially normal to the direction of the stream.

10. Corona discharge static neutralizing apparatus comprising:

one ionizing electrode formed as a conductive wire disposed in a loop configuration on a support member;

another electrode disposed in one direction away from the one ionizing electrode;

another ionizing electrode formed as a conductive wire disposed in a loop configuration on a support member spaced away from the one ionizing electrode with the loops of the ionizing electrodes disposed substantially in a common plane; and a structure for moving gas in a direction past said electrodes toward an object to be neutralized of static charge.

11. Corona discharge static neutralizing apparatus according to claim 10 in which the loop of the one ionizing electrode has a radius in the range from about 0.05 inches to about 2.0 inches.

12. Corona discharge static neutralizing apparatus according to claim 10 in which the loop is disposed substantially within a plane; and the structure moves gas in a direction substantially normal to the plane of the loop.

13. Corona discharge static neutralizing apparatus according to claim 12 in which said another electrode is spaced away from an edge of the loop in the one direction that is aligned substantially within the plane of the loop.

14. Corona discharge static neutralizing apparatus for disposition within a flowing gas stream, the apparatus comprising:

a support member formed in substantially H-shape of electrically non-conductive material including conductive regions disposed thereon near pairs of spaced ends that are disposed substantially within a common plane;

at least one wire electrode supported in tension between the conductive regions near each pair of the spaced ends of the support member; and a reference electrode disposed intermediate the wire electrodes supported between the pairs of conductive regions.

15. Corona discharge static neutralizing apparatus for disposition within a flowing gas stream directed toward an object for neutralizing the object of electrostatic charges, the apparatus comprising:

a substantially flat support member of non-conductive material including conductive regions disposed thereon near spaced ends;

at least one wire electrode supported in tension between the conductive regions near the spaced ends of the support member;

a reference electrode disposed away from the wire electrode substantially in a common plane therewith;

a structure disposed to form a flowing gas stream about the support member;

a source of high ionizing voltage connected to the wire electrode, and a source of reference voltage connected to the reference electrode to provide an ion stream along a direction between the wire electrode and the reference electrode; and said structure is disposed relative to the support member for moving gas in a stream along a direction skewed relative to the direction of the ion stream.

16. Corona discharge static neutralizing apparatus according to claim 15 in which the reference electrode is disposed upstream relative to the wire electrode.

17. Corona discharge static neutralizing apparatus according to claim 15 in which the source of high ionizing voltage connected to the wire electrode supplies thereto AC or pulsed DC having a rate of cyclic change of a parameter in the range from about 0.1 to about 100,000 cycles per second.

18. Corona discharge static neutralizing apparatus for disposition within a flowing gas stream, the apparatus comprising:

a support member of non-conductive material including conductive regions disposed thereon near pairs of spaced ends that are disposed substantially within a common plane;

at least two wire electrodes supported in tension between the conductive regions near each pair of the spaced ends of the support member;

a reference electrode disposed intermediate the wire electrodes substantially in the common plane therewith as supported between the pairs of conductive regions, and in substantial alignment with the wire electrodes;

a source of high ionizing voltage of at least one polarity connected to each of the at least two wire electrodes;

a utilization circuit connected to the reference electrode; and a structure disposed relative to the support member for moving gas in a stream along a direction skewed relative to the spacing between the at least two wire electrodes.

19. Corona discharge static neutralizing apparatus according to claim 18 in which the utilization circuit senses charge on the reference electrode for controlling the formation of ions by at least one of the wire electrodes.

20. Corona discharge static neutralizing apparatus according to claim 19 in which the plane formed by the wire electrode and the support member is disposed substantially normal to the direction of the moving stream.

21. Corona discharge static neutralizing apparatus according to claim 18 in which the wire electrodes are connected to sources of high ionizing voltages of opposite polarities.

22. Corona discharge static neutralizing apparatus for disposition within a flowing gas stream directed toward an object for neutralizing the object of electrostatic charges, the apparatus comprising:

a substantially flat support member of non-conductive material including conductive regions disposed thereon near a pair of spaced ends;

at least one wire electrode supported in tension between the conductive regions near the pair of spaced ends of the support member;

a reference electrode disposed away from the wire electrode substantially in a common plane therewith; and, a structure disposed to form a flowing gas stream about the support member, said support member and wire electrode being positioned within a plane upstream of said structure.

23. Corona discharge static neutralizing apparatus for disposition within a flowing gas stream directed toward an object for neutralizing the object of electrostatic charges, the apparatus comprising:

a substantially flat support member of non-conductive material including conductive regions disposed thereon near a pair of spaced ends;

at least one wire electrode supported in tension between the conductive regions near the pair of spaced ends of the support member;

a reference electrode disposed away from the wire electrode substantially in a common plane therewith; and a structure disposed to form a flowing gas stream about the support member, said support member and the wire electrode being positioned within a plane downstream of said structure.

24. Corona discharge static neutralizing apparatus for disposition within a flowing gas stream directed toward an object for neutralizing the object of electrostatic charges, the apparatus comprising:

a substantially flat support member of non-conductive material including conductive regions disposed thereon near a pair of spaced ends;

at least one wire electrode supported in tension between the conductive regions near the pair of spaced ends of the support member;

a reference electrode disposed away from the wire electrode substantially in a common plane therewith;

a structure disposed to form a flowing gas stream about the support member, said support member being disposed along a conduit for gas under pressure including at least one nozzle for releasing gas under pressure therethrough in a direction substantially aligned opposite the spacing from the wire electrode toward the reference electrode.

25. Corona discharge static apparatus according to claim 24 including a plurality of nozzles disposed for releasing gas under pressure therethrough in substantially said direction on opposite sides of the support member.

26. A method of forming a flowing stream of a gas containing ions, comprising:

confining a flowing stream of the gas within a selected cross-sectional area;

positioning a loop electrode disposed substantially in a plane within the cross-sectional area of the confined stream of gas;

positioning another wire electrode spaced away from an edge of the loop electrode in a direction that is substantially normal to the direction of the flowing stream of gas; and applying high ionizing voltage to the loop electrode for producing ions in the flowing stream of gas.

27. The method according to claim 26 in which positioning includes orienting the plane of the loop electrode substantially parallel to a direction of the flowing stream of gas.

* * * * *